US008931870B2

(12) United States Patent
Weissman et al.

(10) Patent No.: US 8,931,870 B2
(45) Date of Patent: Jan. 13, 2015

(54) PRINTING SYSTEM AND METHOD

(75) Inventors: Liad Weissman, Hod Hasaron (IL); Ran Vilk, Qiryat Ono (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 72 days.

(21) Appl. No.: 13/603,607

(22) Filed: Sep. 5, 2012

(65) Prior Publication Data

US 2014/0063093 A1 Mar. 6, 2014

(51) Int. Cl.
*B41J 2/165* (2006.01)

(52) U.S. Cl.
CPC ..... *B41J 2/16523* (2013.01); *B41J 2/16526* (2013.01); *B41J 2002/16529* (2013.01)
USPC ..... 347/9; 347/35

(58) Field of Classification Search
CPC ..... B41J 2/165; B41J 2/16505; B41J 2/16523
USPC ..... 347/9, 35
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 6,170,946 | B1 * | 1/2001 | Yasui et al. | 347/108 |
| 6,561,621 | B2 | 5/2003 | Webster et al. | |
| 7,175,251 | B2 | 2/2007 | Gaston et al. | |
| 7,731,329 | B2 | 6/2010 | Yearout et al. | |
| 7,828,407 | B2 | 11/2010 | Gomez et al. | |
| 2003/0063151 | A1 * | 4/2003 | Bauer | 347/35 |
| 2007/0057983 | A1 * | 3/2007 | Kawaguchi et al. | 347/9 |
| 2010/0283816 | A1 | 11/2010 | Blackman et al. | |
| 2011/0069128 | A1 * | 3/2011 | Onishi | 347/102 |
| 2012/0081446 | A1 * | 4/2012 | Usuda et al. | 347/16 |

OTHER PUBLICATIONS

Kadansky Consulting, Inc., "Practical Computer Advice from Martin Kadansky," Personalized Computer Services, vol. 5, Issue 1, Jan. 2011, 6 p.

* cited by examiner

*Primary Examiner* — Geoffrey Mruk
*Assistant Examiner* — Scott A Richmond
(74) *Attorney, Agent, or Firm* — Hewlett-Packard Patent Department; Adam Franks

(57) ABSTRACT

According to one example there is provided a method of printing an image on a substrate using a printing system having a printhead. The method comprises forming, using ink from the printing system, a spittoon on the substrate, printing the image on the substrate, and whilst printing the image, ejecting ink from a printhead into the formed spittoon during a printhead maintenance operation.

17 Claims, 3 Drawing Sheets

PRINTING SYSTEM AND METHOD

BACKGROUND

Inkjet printheads may suffer from printhead nozzles becoming blocked or partially obstructed when not used for a certain length of time due to ink residue in proximity to the nozzles hardening. Blocked or obstructed printhead nozzles may lead to print quality issues, especially if ink drops are not ejected by a nozzle as planned during a printing operation.

A blocked or obstructed nozzle may generally be cleared by causing the nozzle to fire one or multiple ink drops from the nozzle. This purging operation is generally known as spitting. Generally, spitting is performed over a special reservoir, known as a spittoon, incorporated into the printing system and into which purged ink is received. Typically a printhead is moved out of a print zone and into a service station zone comprising a spittoon.

BRIEF DESCRIPTION OF THE DRAWINGS

Examples, or embodiments, of the invention will now be described, by way of non-limiting example only, with reference to the accompanying drawings, in which.

DETAILED DESCRIPTION

Figure 1:
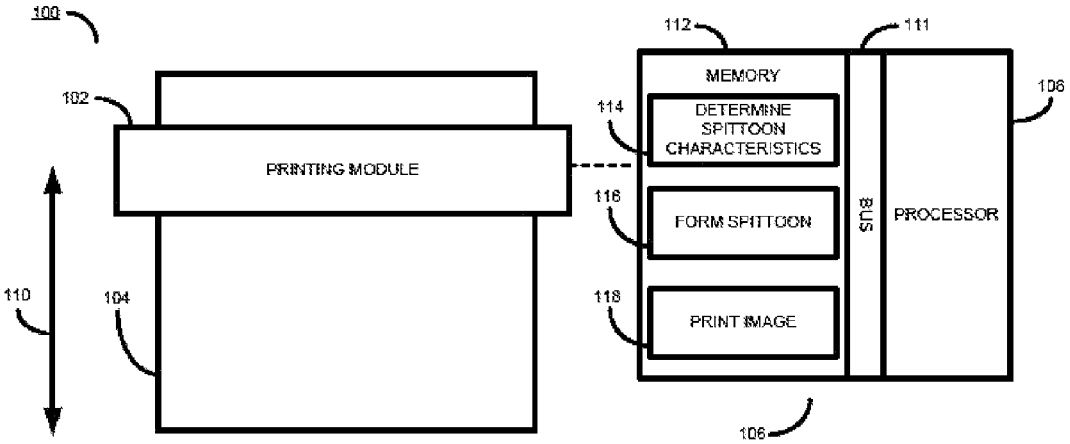
FIG. 1 is a simplified block diagram showing a portion of a printing system according to one example.

Referring now to FIG. 1 there is shown a printing system 100 according to one example. The printing system 100 comprises a printing module 102 for printing on a substrate 104. The printing system 100 is controlled by a controller 106.

In one example the printing module 102 comprises a carriage (not shown) on which are mounted multiple inkjet printheads. The printheads may be thermal inkjet printheads, piezo inkjet printheads, or any other suitable type of printhead.

In one example the carriage scans across the width of the substrate 104 to enable an image swath to be printed thereon. Relative motion in a media advance axis 110 between the printing module 102 and the substrate 104 allows multiple swaths to be printed on the substrate 104 and thus enables an image to be printed, in an incremental manner, on the substrate 104. In one example the printing module 102 remains stationary and the substrate 104 is moved under printing module 102, for example by a moveable substrate support table (not shown) or other media handling system. In another example the printing module 102 is moved over a substrate 104 held stationary on a substrate support.

In some examples relative movement between the printing module 102 and the substrate 104 is possible bi-directionally in the media advance axis 110.

In another example the printing module 102 comprises an array of printheads on a print bar that spans completely or substantially the width of the substrate 104 in a so-called page-wide array configuration. In this example the printheads do not scan across the width of the substrate 104, although in some examples some limited lateral movement of the print bar may be possible.

The controller 106 controls the printing system 100 to print an image on the substrate 104. The controller 106 receives or derives printhead control data from an image to be printed and controls the printing module 102 accordingly to print the image.

Figure 2:
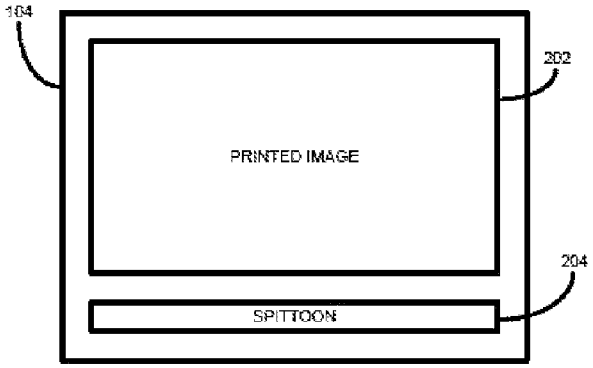
FIG. 2 is an illustration of a substrate having a printed spittoon according to one example.

The controller 106 is also configured to control the printing system 100 to form a spittoon (204) on the substrate 108, as illustrated in FIG. 2, and to use the formed spittoon 204 for printhead nozzle spitting or purging operations when printing an image 202 which is also printed on the substrate 104.

The spittoon 204 may be formed on any suitable portion of the substrate 104 that does not coincide or otherwise interfere with the printed image 202.

In one example the printing module uses ultra-violet (UV) curable inks. UV curable inks are inks which are cured once deposited on a substrate by use of a UV source or sources. A UV source may comprise a UV lamp. A UV source or sources may, for example, be mounted on a printhead carriage or print bar or may be mounted along the whole, or along just a portion of the length, of the printing module 102 depending on particular requirements.

The spittoon 204 is formed by a raised boundary, or frame, enclosing an area of the substrate 104. The raised boundary may be formed, for example, by printing a boundary using a UV curable ink, such as a black ink.

When using UV curable inks the spittoon 204 may be formed, layer by layer, by printing a boundary layer, for example using black ink, and curing the printed boundary layer. A further boundary layer is subsequently printed atop the cured boundary layer, and the further boundary layer is cured. By repeating this process multiple times a raised boundary is formed. The height of each boundary layer formed will depend on particular characteristics on the ink used to print the boundary as well as the amount of ink used to print each boundary layer.

Figure 3:
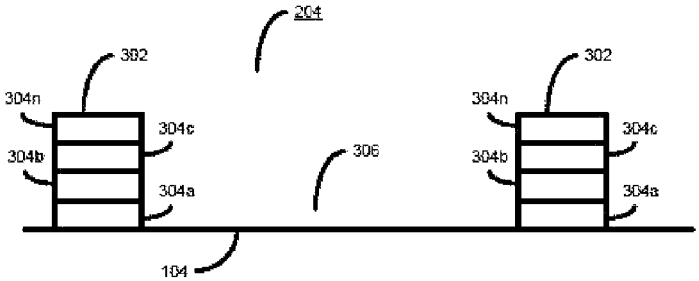
FIG. 3 is a simplified cross-section view of a printed spittoon according to one example.

FIG. 3 shows a simplified cross-section view of the spittoon 204. The spittoon 204 comprises a raised boundary 302 printed on a substrate 104 that encompasses a portion 306 of the substrate 104. The raised boundary 302 is formed from a number of layers of printed and cured ink 304*a* to 304*n*.

In one example, the number of layers used to form the raised boundary 302 may comprise between 10 and 100 layers, depending on particular requirements. In other examples a greater or smaller number of layers may be used.

Once the spittoon 204 has been formed to a desired height, the area enclosed by the raised boundary may be used by the printing system 100, when printing an image, to purge or spit ink from different ones of the printhead nozzles in the printing module 102 as required.

As illustrated in FIG. 1, the controller 106 comprises a processor, such as a microprocessor or microcontroller 108, that is coupled to, and is in communication with, a memory 112 via a communications bus 111. The memory 112 stores processor executable instructions 114 that when executed by the processor 108 cause the processor to determine characteristics of a spittoon to be formed. The memory 112 also stores processor executable instructions 116 that when executed by the processor 108 cause the processor to form a spittoon as the determined on the substrate. The memory 112 also stores processor executable instructions 118 that when executed by the processor 108 cause the processor to print an image to be printed and to use the spittoon formed on the substrate in nozzle purging operations.

Figure 4:
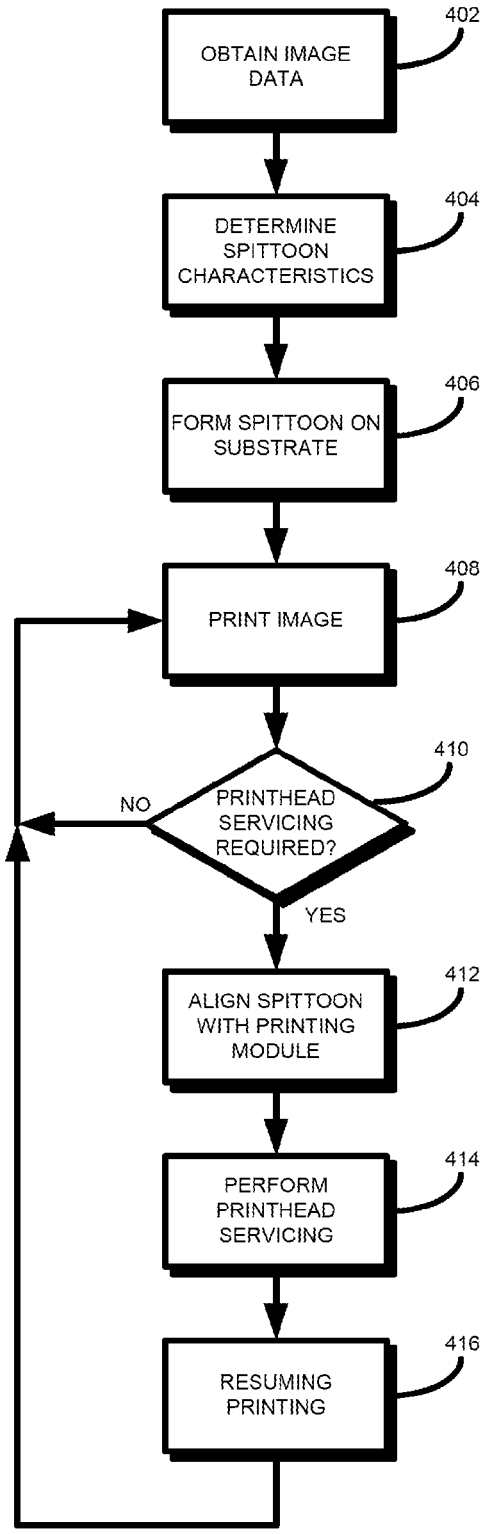
FIG. 4 is a flow diagram outlining an example method of operating a printing system according to one example.

A method of operating the printing system 100 according to one example is described below with additional reference to the flow diagram of FIG. 4.

At block 402 the controller 106 obtains image data for an image to be printed on a substrate.

At block 404 the controller 106 determines characteristics for a spittoon to be formed on the substrate. Characteristics include, for example, the location of the spittoon on the substrate, the dimensions of the spittoon, the capacity of the spittoon, and the shape of the spittoon. The characteristics may be determined, for example, based on the size of the substrate, the size of the image to be printed, the type of printing module, the size of a printhead present in the printing module, the configuration of printheads in the printing module, and space on the substrate where the spittoon can be formed without interfering with the image to be printed.

At block 406 the controller 106 controls the printing system 100 to form the spittoon having the determined characteristics. As previously described, this may include printing multiple superimposed layers of ink to form a spittoon boundary. In some examples the ink may be UV curable ink and each layer of ink may be cured before printing the next layer. In other examples multiple layers of ink may be printed before being cured.

At block 408 the controller 106 controls the printing system 100 to start printing the image.

At block 410 the controller 106 determines, whilst printing the image, whether a printhead service operation that requires the spittoon, such as a purge or spitting operation, is to be performed. If it is determined that no such operation is needed the controller 106 controls to the printing system 100 to continue printing (block 408) the image. Otherwise, the controller 106 suspends printing of the image and aligns (block 412) the spittoon with the printing module 102. This may be achieved, for example, by either moving the printing module 102 to be aligned over the spittoon formed on the substrate 104, or by moving the substrate 104 such that the spittoon formed thereon is aligned under the printing module 104.

At block 414 the controller 106 controls the printing system 100 to perform the required servicing operation, such as a nozzle purging or spitting operation, such that ink used during the servicing operation is directed to the area 306 within the boundary area 302 of the spittoon 204.

Once the servicing operation has terminated, the controller 106 controls the printing system 100 to continue (block 416) printing of the image. This may include restoring the relative position of the printing module 102 and substrate 104 prior to the servicing operation.

Figure 5:
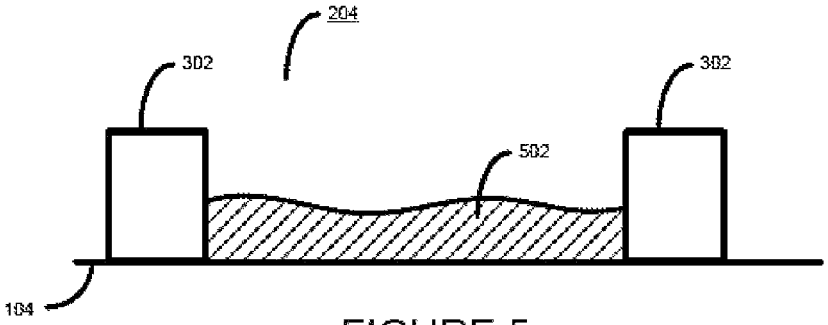
FIG. 5 is a simplified cross-section view of a printed spittoon according to one example.

During the printing of an image the printed spittoon 204 fills up with ink 502, as illustrated in FIG. 5.

In one example, if the controller 106 determines that the spittoon is above a predetermined fill level the controller 106 may control the printing system 100 to add additional ink layers to the spittoon boundary to increase the capacity of the printed spittoon. In one example the determination as to the fullness of the spittoon may be based on drop counting of purged ink.

In one example when printing of the image 202 has been completed the controller 106 may control UV sources on the printing module to cure or partially cure ink deposited in the spittoon 204. This helps prevent non-cured ink from spilling out from the spittoon when the substrate 104 is removed from the printing system 100.

In a further example, when printing of the image 202 has been completed the controller 106 may control a cutting module (not shown) to separate the printed image 202 from the printed spittoon 204, thereby enabling the printed image to be removed from the printing system 100 without the risk of causing damage to the image by non-cured ink in the printed spittoon 204.

In a yet further example, the spittoon 204 may be formed on a separate substrate to the substrate on which the printed image 202 is formed. For example, if a flatbed substrate support is used, a portion of the substrate support may be used to receive a substrate on which a spittoon is printed, and a further portion of the substrate support may be used to receive a substrate on which an image is to be formed. In this example, a spittoon formed on a separate substrate may be used as a spittoon by the printing system 100 during the printing of multiple images on multiple separate substrates.

In a further example the controller 106 controls the printing system 100 to progressively print layers of the spittoon boundary 302 whilst progressively printing the image 202.

One advantage of the printing a disposable spittoon according to the above-described examples is that it avoids problems associated with internal spittoons, such as ink contamination of internal printing system elements, and difficulty in replacing internal spittoons.

It will be appreciated that examples and embodiments of the present invention can be realized in the form of hardware, software or a combination of hardware and software. In one example a computer program product may be provided having stored thereon instructions that may be executed by a processor to program a processor (or other electronic device) to perform processes described herein. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A printing system, comprising:

a printing module comprising an inkjet printhead;

a controller;

a memory in communication with the controller; and controller executable instructions stored in the memory and executable by the controller to control the printing system to:

print a spittoon on a substrate such that the spittoon is defined by a raised boundary that encloses a surface area on the substrate, wherein the surface area encompasses the entire area on the substrate that is enclosed by the raised boundary;

print an image outside of the surface area enclosed by the raised boundary; and whilst printing the image, ejecting ink from the printhead into the surface area enclosed by the raised boundary of the printed spittoon whilst performing a printhead servicing operation.

2. The printing system of claim 1, wherein the controller executable instructions stored in the memory further comprise instructions to control the printing system to:

form the raised boundary by repeatedly printing and curing layers of ultra-violet curable ink to form a raised spittoon frame.

3. The printing system of claim 1, wherein the controller executable instructions stored in the memory further comprise instructions to control the printing system to:

determine a position on the substrate at which the spittoon is to be formed;

determine the dimensions of the spittoon to be formed; and form the spittoon having the determined dimensions at the determined position on a substrate.

4. The printing system of claim 1, wherein the controller executable instructions stored in the memory further comprise instructions to control the printing system to:

cure ink ejected in the formed spittoon once the image has been printed.

5. The printing system of claim 1, wherein the controller executable instructions stored in the memory further comprise instructions to control the printing system to:

cut the substrate on which are formed the spittoon and the printed image to allow the printed image to be separated from the formed spittoon.

6. The printing system of claim 1, wherein the controller executable instructions stored in the memory further comprise instructions to control the printing system to:

form the spittoon on the substrate; and print the image on a second, separate, substrate.

7. A printing system, comprising:

a printing module comprising an inkjet printhead;

a controller;

a memory in communication with the controller; and controller executable instructions stored in the memory and executable by the controller to control the printing system to:

print a spittoon on a substrate by repeatedly printing and curing layers of ultra-violet curable ink to form a raised spittoon frame;

print an image; and whilst printing the image, ejecting ink from the printhead into the printed spittoon whilst performing a printhead servicing operation;

increase the capacity of the formed spittoon by printing and curing additional layers of ultra-violet curable ink to raise the height of the spittoon frame.

8. The printing system of claim 7, wherein the controller executable instructions stored in the memory further comprise instructions to control the printing system to:

determine a position on the substrate at which the spittoon is to be formed;

determine the dimensions of the spittoon to be formed; and form the spittoon having the determined dimensions at the determined position on a substrate.

9. The printing system of claim 7, wherein the controller executable instructions stored in the memory further comprise instructions to control the printing system to:

cure ink ejected in the formed spittoon once the image has been printed.

10. The printing system of claim 7, wherein the controller executable instructions stored in the memory further comprise instructions to control the printing system to:

cut the substrate on which are formed the spittoon and the printed image to allow the printed image to be separated from the formed spittoon.

11. The printing system of claim 7, wherein the controller executable instructions stored in the memory further comprise instructions to control the printing system to:

form the spittoon on the substrate; and print the image on a second, separate, substrate.

12. A printing system, comprising:

a printing module comprising an inkjet printhead;

a controller;

a memory in communication with the controller; and controller executable instructions stored in the memory and executable by the controller to control the printing system to:

print a spittoon on a substrate such that the spittoon is defined by a raised outer boundary that encloses a surface area on the substrate and defines a volume;

print an image; and whilst printing the image, ejecting ink from the printhead into the printed spittoon whilst performing a printhead servicing operation, thereby at least partially filling the volume with the ejected ink.

13. The printing system of claim 12, wherein the controller executable instructions stored in the memory further comprise instructions to control the printing system to:

form the raised boundary by repeatedly printing and curing layers of ultra-violet curable ink to form a raised spittoon frame.

14. The printing system of claim 12, wherein the controller executable instructions stored in the memory further comprise instructions to control the printing system to:

determine a position on the substrate at which the spittoon is to be formed;

determine the dimensions of the spittoon to be formed; and form the spittoon having the determined dimensions at the determined position on a substrate.

15. The printing system of claim 12, wherein the controller executable instructions stored in the memory further comprise instructions to control the printing system to:

cut the substrate on which are formed the spittoon and the printed image to allow the printed image to be separated from the formed spittoon.

16. The printing system of claim 12, wherein the controller executable instructions stored in the memory further comprise instructions to control the printing system to:

form the spittoon on the substrate; and print the image on a second, separate, substrate.

17. The printing system of claim 12, wherein the controller executable instructions stored in the memory further comprise instructions to control the printing system to:

cure ink ejected in the formed spittoon once the image has been printed.

* * * * *

UNITED STATES PATENT AND TRADEMARK OFFICE

CERTIFICATE OF CORRECTION

PATENT NO. : 8,931,870 B2
APPLICATION NO. : 13/603607
DATED : January 13, 2015
INVENTOR(S) : Liad Weissman et al.

It is certified that error appears in the above-identified patent and that said Letters Patent is hereby corrected as shown below:

ON THE TITLE PAGE

Item (75), Inventors, in column 1, line 1, delete "Hod Hasaron" and insert -- Hod Hasharon --, therefor.

Signed and Sealed this
Tenth Day of May, 2016

Michelle K. Lee

Michelle K. Lee
*Director of the United States Patent and Trademark Office*